US012698564B2

(12) United States Patent
Mühlberger

(10) Patent No.: US 12,698,564 B2
(45) Date of Patent: Aug. 4, 2026

(54) METHOD FOR COATING ZINC DIE-CAST PARTS, MULTI-LAYERED COATING FOR THE PROTECTION OF ZINC DIE-CAST PARTS, AND COATED ZINC DIE-CAST PART

(71) Applicant: FNT-GMBH, Rudersberg (DE)

(72) Inventor: Volker Mühlberger, Rutesheim (DE)

(73) Assignee: FNT-GMBH, Rudersberg (DE)

( * ) Notice: Subject to any disclaimer, the term of this patent is extended or adjusted under 35 U.S.C. 154(b) by 0 days.

(21) Appl. No.: 18/289,439

(22) PCT Filed: Feb. 16, 2022

(86) PCT No.: PCT/DE2022/200022

§ 371 (c)(1),
(2) Date: Nov. 3, 2023

(87) PCT Pub. No.: WO2022/233369

PCT Pub. Date: Nov. 10, 2022

(65) Prior Publication Data

US 2024/0254631 A1 Aug. 1, 2024

(30) Foreign Application Priority Data

May 6, 2021 (DE) ..... 10 2021 204 609.6

(51) Int. Cl.

| | |
|---|---|
| ***C23C 28/00*** | (2006.01) |
| ***C23C 22/34*** | (2006.01) |
| ***C23C 22/73*** | (2006.01) |
| ***C23C 22/78*** | (2006.01) |
| ***C23C 24/10*** | (2006.01) |

(52) U.S. Cl.

CPC ..... *C23C 28/322* (2013.01); *C23C 22/34* (2013.01); *C23C 22/73* (2013.01); *C23C 22/78* (2013.01); *C23C 24/10* (2013.01); *C23C 28/345* (2013.01); *C23C 2222/10* (2013.01)

(58) Field of Classification Search

None

See application file for complete search history.

(56) References Cited

U.S. PATENT DOCUMENTS

| | | | | |
|---|---|---|---|---|
| 2019/0145009 | A1* | 5/2019 | Volk | C23C 22/34 148/247 |
| 2020/0121816 | A1* | 4/2020 | Grossman | A01G 20/30 |
| 2020/0353118 | A1* | 11/2020 | Lake | A61L 2/28 |

FOREIGN PATENT DOCUMENTS

| | | | | |
|---|---|---|---|---|
| WO | WO-02087339 | A1 * | 11/2002 | A01N 25/34 |

* cited by examiner

*Primary Examiner* — Shamim Ahmed
*Assistant Examiner* — Bradford M Gates
(74) *Attorney, Agent, or Firm* — Wenderoth, Lind & Ponack, L.L.P.

(57) ABSTRACT

A method for coating zinc die-cast parts is described, as well as a multi-layered coating for the protection of zinc die-cast parts and a coated zinc die-cast part.

9 Claims, 2 Drawing Sheets

Figure 1:
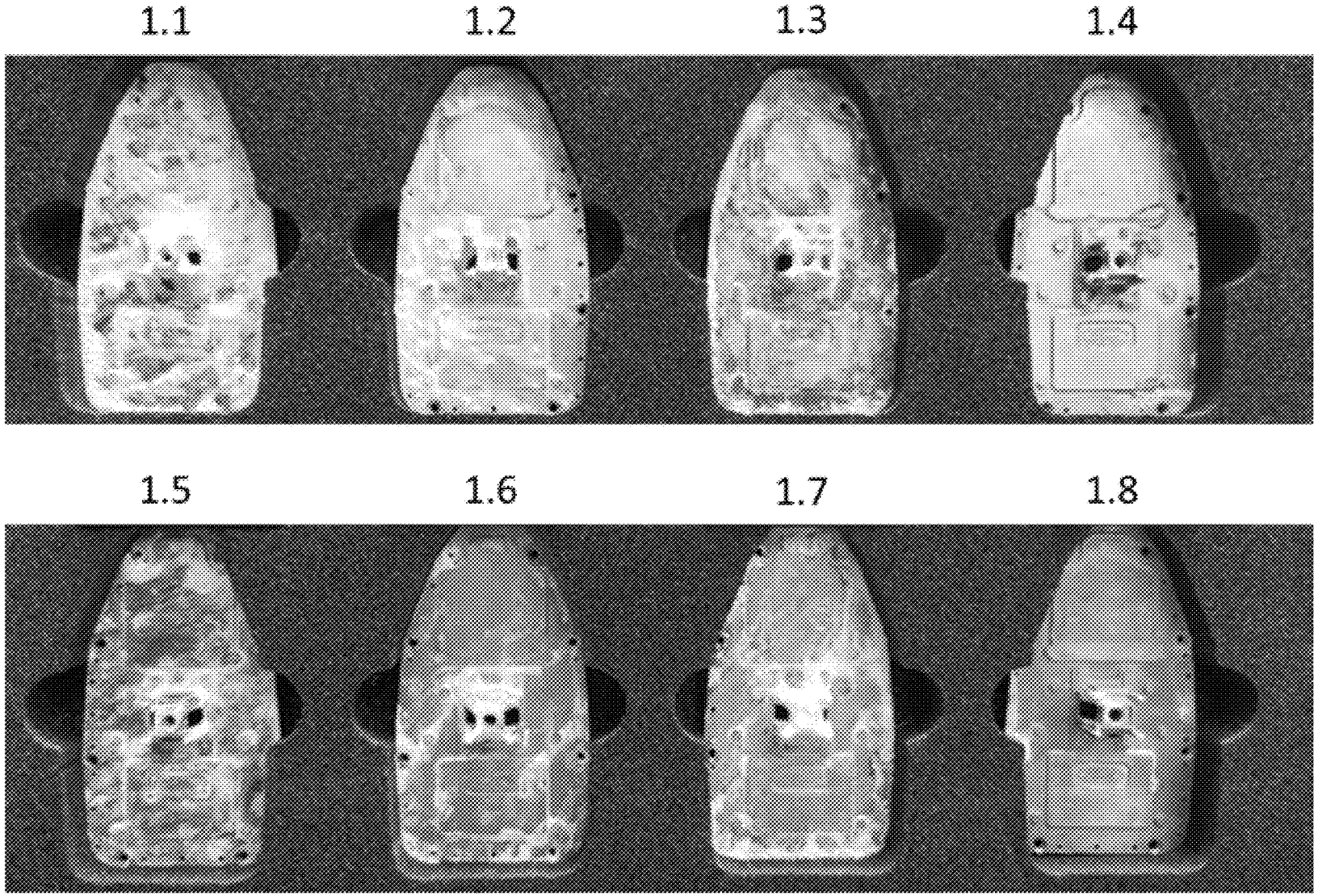

METHOD FOR COATING ZINC DIE-CAST PARTS, MULTI-LAYERED COATING FOR THE PROTECTION OF ZINC DIE-CAST PARTS, AND COATED ZINC DIE-CAST PART

This invention concerns a method for coating zinc die-cast parts, a multilayer coating for the protection of zinc die-cast parts, and a coated zinc die-cast part.

Zinc die casting allows the rapid production of large quantities of components from a single mold with high repeatability and very tight manufacturing tolerances. To ensure strength, many components are now manufactured using zinc die-cast technology. Zinc die-cast components are used in a wide variety of applications, and are found in many areas of everyday life, including automotive, mechanical and apparatus engineering, electrical engineering and electronics, and construction. This means that zinc die-cast parts have to withstand a wide range of environmental conditions.

Although zinc already has a naturally high level of corrosion protection, this can be further increased by refining the surface of zinc die-cast parts. For example, the surface can be coated to protect the component against abrasion and corrosion.

Typically, zinc die castings are first electroplated with zinc and then either chromated with chromium(VI) or passivated with chromium(III) to coat this zinc layer. However, the treatment of surfaces with chromium(VI) poses health risks, and has therefore been banned throughout Europe.

Chromium(III) passivation via electroplating carries the risk of faulty pre-treatment or problems during the main treatment, such as the incorporation of hydrogen during the coating process, which leads to blistering. Frequently, poor penetration or depth distribution, known as a shielding effect, also occurs. Often, the thickness of the coating at edges, recesses, or holes can significantly differ from the thickness of the coating on the flat surfaces. Furthermore, coating by means of electroplating is time-consuming and requires many individual steps. The disposal of the solutions used for electroplating is also problematic, as they need to be disposed of and processed separately due to their components.

Since galvanized zinc die-cast parts, unlike steel parts, cannot be easily stripped of their coating, there have been repeated attempts in the past to directly coat zinc die-castings, which are composed of approximately 95% zinc. This approach was aimed at saving costs and time as well. However, the same problems have arisen time and again. For example, sometimes the parts turned a dark gray color and became uneven, and the surfaces did not provide sufficient corrosion protection.

The presented invention has therefore emerged from the challenge of providing a method of coating zinc die cast parts that overcomes the above problems.

With this invention as described here, the aforesaid task is solved by the features of claim 1. Thereafter, the invention provides a method for coating zinc die-cast parts that comprises the following steps:

i) treating the zinc die-cast parts with a first liquid containing at least one builder and at least one surfactant;

ii) treating the zinc die-cast parts with a second liquid to form a first layer on the surface of the zinc die-cast parts, where the second liquid contains at least one chromium(III) complex and at least one sulfate;

iii) treating the zinc die-cast parts with a third liquid to form a second layer on the first layer, where the third liquid contains inorganic nanoparticles; and iv) drying of the treated zinc die cast parts.

To apply the coating, the surface of the zinc die-cast part must first be activated. Activation of the surface is generally understood to mean increasing the reactivity of the surface by removing or chemically transforming inactive substances, and/or by eliminating oxide or passive layers. Sufficient surface activation is a prerequisite for ensuring an adequate formation of the coating.

The zinc die-cast parts are activated by the treatment with the first liquid. The first fluid comprises at least one builder. Experts are familiar with the use of builders from surface technology, particularly the pre-treatment of surfaces. Builders are used to adjust the pH and simultaneously remove oxide layers and contaminants from the surface of the component to be coated. The preferred builders are phosphates, especially polyphosphates such as triphosphates. The use of potassium tripolyphosphate as builder is particularly suitable for the process. In one embodiment of the method, the builder is a phosphate, preferably a polyphosphate.

As surface activation involves (among other things) the dissolution of aluminum from the surface of the zinc die-cast part, the builder can regulate this dissolution. For this purpose, the builder must be present in the first liquid at a concentration of at least 4.0 g/L. At lower concentrations, the attack on the surface is too strong and the leveling of the surface is insufficient. At builder concentrations exceeding 12.0 g/L, the reduction of aluminum content, and thus surface activation, is not sufficient.

In another embodiment, the concentration of the builder in the first liquid ranges from 4.0 g/L to 12.0 g/L. Preferably, the concentration in the first liquid falls within the range of 6.0 g/L to 10.0 g/L. Specifically, the concentration of the builder in the first liquid can be 4.0 g/L, 4.5 g/L, 5.0 g/L, 5.5 g/L, 6.0 g/L, 6.5 g/L, 7.0 g/L, 7.5 g/L, 8.0 g/L, 8.5 g/L, 9.0 g/L, 9.5 g/L, 10.0 g/L, 10.5 g/L, 11.0 g/L, 11.5 g/L, or 12.0 g/L.

The first liquid includes at least one surfactant. Surfactants are responsible for both ensuring the optimal wetting of zinc die-cast parts by reducing the surface tension of the liquid and for detaching and absorbing substances such as (e.g.) oils, release agents, and emulsions. Non-ionic surfactants are particularly suitable for the process used in the invention. Ethoxylated fatty alcohols are the preferred non-ionic surfactants. For example, in the first liquid, ethoxylated fatty alcohols such as decan-1-ol, with an ethoxylation degree of 1-10, can be used. The preferred surfactant is decan-1-ol with a degree of ethoxylation of 5. It is sold under the brand name Zusolat 1005/85.

In another embodiment, the surfactant is a non-ionic surfactant. It is preferable for the surfactant to be an ethoxylated fatty alcohol.

In a preferred embodiment, the builder is a phosphate, preferably a polyphosphate, and the surfactant is a non-ionic surfactant, preferably an ethoxylated fatty alcohol.

The surfactant can be used in the first liquid with a concentration of 0.1 g/l-1.0 g/l. Preferably, the surfactant can be used at a concentration of 0.2 g/l-0.6 g/l. In particular, the concentration of the surfactant in the first liquid can be 0.1 g/L, 0.2 g/L, 0.3 g/L, 0.4 g/L, 0.5 g/L, 0.6 g/L, 0.7 g/L, 0.8 g/L, 0.9 g/L, or 1.0 g/L. At concentrations below 0.1 g/L, there is a risk that sufficient wetting of the surface may not be guaranteed in the subsequent treatment steps. If the surfactant concentration is too high, it can lead to a significant increase in foam formation. This can be problematic, especially during the treatment with the second liquid, as it may hinder the immediate start of layer formation.

In another embodiment, the surfactant concentration in the first liquid ranges from 0.1 g/L to 1.0 g/L. Preferably, the surfactant is present in the first liquid at a concentration of 0.2 g/L to 0.6 g/L.

Furthermore, a substance can be added to the first liquid to regulate its cloud point and, consequently, its low foam formation. Such a substance might be (e.g.) a hydrotrope. Amphoteric surfactants are suitable hydrotropes. In one embodiment, the first liquid also includes a hydrotrope. It is preferable for this hydrotrope to be an amphoteric surfactant. Examples of suitable amphoteric surfactants include N-(2-carboxyethyl)-N-(2-ethylhexyl)-β-alanine sodium salts (e.g., Amphotensid® EH), octyliminodipropionates (e.g., Ampholak YJH-40), amphopolycarboxyglycinates (e.g., Ampholak 7CX/C or Ampholak 7TX), or coconut oil fatty acid imino-propionates (e.g., Ampholak YCE).

In the first liquid, the hydrotrope can be present at a concentration of 0.5 g/L to 3.0 g/L. Below 0.5 g/L, low-foaming control is not sufficient and liquid separation may occur, resulting in (among other things) surfactant flocculation. Above a concentration of 3.0 g/L, the effect of the hydrotrope is not significantly increased, making it economically unnecessary to use a higher concentration. The preferred concentration is 0.8-2.5 g/L. Specifically, the hydrotrope can be present at a concentration of 0.5 g/L, 0.8 g/L, 1.0 g/L, 1.3 g/L, 1.5 g/L, 1.8 g/L, 2.0 g/L, 2.2 g/L, 2.4 g/L, 2.6 g/L, 2.8 g/L, or 3.0 g/L.

In another embodiment, the hydrotrope is present in the first liquid at a concentration ranging from 0.5 g/L to 3.0 g/L, preferably at a concentration of 0.8 g/L to 2.5 g/L.

Optimal dissolution of aluminum from the surface of zinc die-cast parts can be achieved at a pH in the range of 11 to 12. pH values above 12 can lead to surface corrosion into deeper layers, which is not desired. Hydrogen formation also occurs. A higher pH also leads to zinc dissolving from the surface and increased consumption of hydroxyl groups in the first liquid.

In one embodiment, the treatment in step i) is conducted at a pH in the range of 11 to 12.

Even at a pH in the range of 11 to 12, hydroxyl groups from the first liquid are consumed due to the surface activation. This occurs primarily through the dissolution of aluminum from the surface and the formation of aluminum hydroxide or aluminate. Caustic soda can be added to keep the pH in the range of 11-12. Dosing can be automatic, e.g. in response to an automated pH measurement.

Accordingly, in another embodiment, the pH of the first liquid is maintained in the range of 11 to 12 by the addition of sodium hydroxide.

The temperature at which the treatment of the zinc die-cast parts with the first liquid is carried out depends on (among other factors) the cloud point of the surfactant used. It has been shown that the best results were achieved at a temperature in the range of 35° C.-55° C. Below 35° C., the cleaning performance of the first liquid decreases, and foam formation is increased. Temperatures above 55° C. resulted in lower cleaning performance and increased energy consumption. Additionally, at higher temperatures, strong evaporation would occur when the zinc die-cast parts are removed from the first liquid, which could lead to undesirable drying of the first liquid's components. This would result in a significantly increased amount of rinsing.

Accordingly, in a further embodiment, the treatment with the first liquid is carried out at a temperature in the range of 35° C.-55° C. It is preferable for the temperature to be in the range of 40° C.-50° C. Specifically, the treatment can be carried out at 35° C., 40° C., 45° C., 50° C. or 55° C.

To achieve sufficient surface activation, the zinc die-cast parts must be treated with the first liquid for at least 30 seconds. The zinc die-cast parts should be continuously wetted with the first liquid. Optimum surface activation results were obtained with a contact time of approximately 60 seconds—i.e., a continuous treatment of the zinc die-cast parts with the first liquid for 60 seconds. Extending the contact time up to 15 minutes has no negative impact on the activation of the surface.

The activated surface of the zinc die-cast parts is then coated with a first layer. This first layer can be a chemical passive layer that is directly built on the activated surface.

For this purpose, the zinc die-cast parts are treated with a second liquid that includes at least one chromium(III) complex and at least one sulfate.

A suitable chromium(III) complex for the process is a chromium(III) fluoride complex. Chromium fluoride is poorly soluble in water. Therefore, chromium(III) fluoride complexes must be used, which have a higher solubility. Chromium(III) fluoride complexes with good solubility can be prepared via (e.g.) the following procedure:

Potassium fluoride is dissolved at a concentration of 1 g/l-5 g/l in water at approximately 80° C. Chromium nitrate is then added at a concentration in the range 10 g/l-20 g/l while stirring. A green fluoride complex forms within seconds. The temperature is kept above 60° C. Subsequently, sodium bisulfate is added at a concentration in the range of 20 g/L to 30 g/L to lower the pH of the solution below 2 to stabilize the formed chromium-fluorine complex.

In another embodiment, the second liquid contains a chromium(III) fluoride complex, preferably a chromium(III) hexafluoride complex. The concentration of the chromium (III) fluoride complex in the second solution can range from 0.3 g/L to 0.7 g/L, preferably in the range of 0.4 g/L to 0.6 g/L. Specifically, the chromium(III) fluoride complex can be present in the liquid at a concentration of 0.3 g/L, 0.35 g/L, 0.4 g/L, 0.45 g/L, 0.5 g/L, 0.55 g/L, 0.6 g/L, 0.65 g/L, or 0.7 g/L.

It has also been shown that a balanced ratio of sulfate ions must be present in the second liquid in order to regulate the thickness of the passive layer. Suitable sulfates include, for example, magnesium sulfate, sodium bisulfate, and potassium bisulfate. Magnesium sulfate, in particular, provides a uniform, slowly building passive layer. Sodium hydrogen sulfate and potassium hydrogen sulfate further stabilize the chromium(III) fluoride complex.

In another embodiment, the sulfate in the second liquid is selected from magnesium sulfate, sodium bisulfate, potassium bisulfate, or combinations thereof. It is preferable for the second liquid to contain magnesium sulfate and/or sodium bisulfate.

The respective sulfate can be present in the second fluid at a concentration in the range of 1 g/L to 5 g/L, preferably in the range of 2 g/L to 4 g/L. Specifically, the sulfate can be present at a concentration of 1.0 g/L, 1.5 g/L, 2.0 g/L, 2.5 g/L, 3.0 g/L, 3.5 g/L, 4.0 g/L, 4.5 g/L, or 5.0 g/L.

In the second liquid, magnesium sulfate can be present at a concentration in the range of 1 g/L to 5 g/L, preferably in the range of 2 g/L to 4 g/L. Specifically, magnesium sulfate can be present at a concentration of 1.0 g/L, 1.5 g/L, 2.0 g/L, 2.5 g/L, 3.0 g/L, 3.5 g/L, 4.0 g/L, 4.5 g/L, or 5.0 g/L.

In the second liquid, sodium bisulfate can also be present at a concentration in the range of 1 g/L to 5 g/L, preferably in the range of 2 g/L to 4 g/L. Specifically, sodium bisulfate can be present at a concentration of 1.0 g/L, 1.5 g/L, 2.0 g/L, 2.5 g/L, 3.0 g/L, 3.5 g/L, 4.0 g/L, 4.5 g/L, or 5.0 g/L.

The treatment with the second liquid is carried out at a pH in the range of 3-4. A pH level lower than 3 would corrode the surface of the zinc die-cast parts, causing excessive dissolution of zinc from the surface. At a pH above 4, the chromium precipitates as chromium hydroxide.

Therefore, in another embodiment, the treatment with the second liquid is carried out at a pH in the range of 3 to 4. Preferably at pH 3.5.

The pH is kept constant at 3-4 by the addition of sulfuric acid. The advantage of using sulfuric acid is that it does not interfere with the build-up of the passive layer.

The first layer can be built up at room temperature. The advantage of this is that there will be no energy consumption for the heating of the second liquid. It also prevents the liquid from evaporating. Consequently, the treatment with the second liquid can be carried out at a temperature in the range of 10° C.-30° C., preferably in the range of 20° C.-30° C. Specifically, the treatment can be carried out at a temperature of 20° C., 25° C., or 30° C.

In another embodiment, the treatment with the second liquid is carried out at a temperature in the range of 10° C.-30° C.

In another embodiment, the first layer is uniformly built up with a thickness of 50 nm-100 nm on the surface of the zinc die-cast parts.

In the case of electroplating coating, additional metal salts such as cobalt, vanadium, tin, or zirconium salts are typically introduced into the layers to further enhance corrosion protection. These metal salts form poorly soluble oxides after drying. Due to the environmental aspects associated with the extraction of these metals, and the classification of some of these metals and/or their compounds as potentially hazardous to health, these substances can be omitted in the present process. Thus, in a preferred embodiment, the coating does not contain cobalt, titanium, vanadium, tin, or zirconium.

In contrast to galvanic processes, the treatment with the second liquid to build up the first layer does not require an electric current. This means that no hydrogen is produced during the process.

While the first layer is uniformly built to a specific thickness, it exhibits tiny recesses, known as capillaries. The number and arrangement of the capillaries varies depending on the composition of the first layer. The depth of the capillaries is irregular, and can reach the base metal. If salt water penetrates the capillaries, corrosion can occur, and the first layer can be destroyed. To avoid this, the capillaries can be partially filled with inorganic nanoparticles that, during drying, transition into a water-insoluble state, thereby at least partially sealing the capillaries.

"Nanoparticles" here refers to a composite of a few to several thousand atoms or molecules of a chemical substance or compound. Nanoparticles may consist of a single substance, or of several substances or combinations of substances. A diameter of 1 nm to 100 nm is essential for nanoparticles. Typically, nanoparticles have special chemical and physical properties that differ significantly from those of the solid or larger particles.

The process described here utilizes the diffusion of the components used in the liquids. The nanoparticles migrate along a concentration gradient from the third liquid into the capillaries and cavities. The capillaries and cavities are filled with liquid, and thus with components such as salts from the treatment with the second liquid. The concentration of inorganic nanoparticles is low in the capillaries and cavities. Consequently, the inorganic nanoparticles aim to achieve a concentration equilibrium. At the same time, the components of the second liquid move out of the capillaries and cavities into the third liquid. This means that no additional energy, such as electricity, is required to build up the second layer at this stage.

The size of the nanoparticles must be kept as small as possible, so that the particles can enter the capillaries, and from there into any cavities in the passive layer. The nanoparticles can have an average diameter in the range of 5 nm-15 nm. Preferably, the nanoparticles have an average diameter of 5 nm, 7 nm, 10 nm, 12 nm or 15 nm.

In a preferred embodiment, the inorganic nanoparticles are in a dispersed form. A dispersion has the additional advantage that the nanoparticles are stabilized in the liquid, and are also evenly distributed throughout the liquid. The third liquid preferably contains the inorganic nanoparticles in the form of a colloidal dispersion. The solids content of the colloidal dispersion can range from 20% by weight to 40% by weight. Preferably, the solids content is in the range of 20 wt. %-30 wt. %. The solid content of the colloidal dispersion is specifically 20% by weight, 25% by weight, 30% by weight, 35% by weight, or 40% by weight.

Enhanced corrosion protection was observed when the colloidal dispersion of nanoparticles with a content of at least 1.5% by weight was used in the third liquid. In one possible embodiment, the colloidal dispersion of nanoparticles can be used in an amount ranging from 1.5% by weight to 10% by weight in the third liquid. Preferably, the colloidal dispersion of nanoparticles is used in an amount ranging from 2% by weight to 8% by weight in the third liquid. Preferably, the colloidal dispersion of nanoparticles is used in an amount ranging from 4% by weight to 6% by weight in the third liquid.

Silicon dioxide particles are particularly suitable as inorganic nanoparticles. Silicon dioxide has the advantage that it can be dispersed in a liquid. The silicon particles can thus be evenly distributed in the liquid, which enables an even treatment of the surface. In addition, the particles are small enough to enter the capillaries. Furthermore, silicon dioxide is stable against potential interfering factors such as ions or temperature variations. Moreover, silicon dioxide is non-toxic and insoluble in water. Thus, the silica particles remain in the liquid when it evaporates or vaporizes. The particles therefore cannot be inhaled through the air that is above the liquid, and so they cannot enter the body through the lungs.

In a preferred embodiment, the inorganic nanoparticles will contain silicon dioxide. It is preferable for the inorganic nanoparticles to consist of silicon dioxide.

In another possible embodiment, the third liquid also contains a polymer dispersion. Preferably, the polymer dispersion is based on ethene or a polyurethane-polycarbonate copolymer. Some options that can be considered are (e.g.) wax emulsions of oxidized polyethylene waxes, such as Poligen® WE 4, Südranol® 220 or Lugalvan® DC. The polymer dispersion binds excess nanoparticles to the surface of the liquid. This is particularly advantageous given that rinsing is no longer allowed after treatment with the third fluid. For this purpose, the polymer dispersion can be used with a content ranging from 3% to 7% by weight, preferably in the range of 4% to 6% by weight, in the third liquid. Specifically, the polymer dispersion can be used with a content of 3% by weight, 3.5% by weight, 4% by weight, 4.5% by weight, 5% by weight, 5.5% by weight, 6% by weight, 6.5% by weight, or 7% by weight.

Furthermore, it has been demonstrated that in the presence of the polymer dispersion, optimal corrosion protection is achieved even at low nanoparticle concentrations in the third solution. In another embodiment, the colloidal dispersion of nanoparticles can be used in the third liquid at a concentration of 1.5%-3.5% when the third liquid contains the polymer dispersion. Specifically, the proportion of the colloidal dispersion of nanoparticles can be 1.5%, 2.0%, 2.5%, 3.0%, or 3.5%.

Suitable polymer dispersions produce a transparent solution that allows impurities to be detected visually. The polymer dispersion must be compatible with the inorganic nanoparticles. If a polymer dispersion is not compatible, the nanoparticles will form a gel. The gelling can be determined by the increase in viscosity. Experts are familiar with suitable methods. For example, measuring viscosity using a 2 mm viscosity flow cup. For diluted liquids, the increase in viscosity can be detected using a syringe tip filter with (e.g.) a 450 nm pore size. If no increase in viscosity is measurable after 6 weeks of storage, it is assumed that the polymer dispersion is compatible with the nanoparticles.

In another embodiment, the treatment of the zinc die-cast parts with the third liquid is carried out at a temperature in the range of 20° C. to 40° C. Above 40° C., the silica dispersion becomes unstable. Below 20° C., the process takes longer due to a lower amount of particle movement. It is preferable for the treatment with the third liquid to be carried out at a temperature in the range of 20° C.-30° C. Specifically, the temperature is 20° C., 25° C., 30° C., 35° C. or 40° C.

The zinc die-cast parts must be treated with the third liquid for a minimum, uninterrupted period of time to allow the nanoparticles to enter the capillaries and settle. An improved corrosion protection was observed in zinc die-cast parts that were treated with the third liquid for at least 30 seconds. It is preferable for the zinc die castings to be treated with the third liquid for at least 45 seconds—more preferably, at least 60 seconds. A treatment time of 30 seconds ensures that the nanoparticles are embedded even in older liquids—i.e., liquids that are reused and contaminated with salts from (e.g.) previous steps. However, stopping treatment with the liquid after 90 seconds is sufficient for an effective procedure.

Treatment with the third liquid is carried out at a pH in the range 7-10. At a pH lower than 7, the polymer dispersion and the inorganic nanoparticles become unstable. At a pH above 10, the stability of the polymer dispersion is also impaired. Consequently, in a further embodiment, treatment with the third liquid is carried out at a pH in the range of 7-10. It is preferable to carry out treatment with the third liquid at a pH in the range 8-10, ideally in the range of 9-10. More specifically, the pH of the third liquid is 7, 8, 9 or 10.

While the inorganic nanoparticles are depositing into the capillaries and cavities of the passive layer, an additional second layer of nanoparticles will be formed on the first layer, the passive layer. This results in the creation of a uniformly thick coating that is easy to clean. The second layer can have a thickness in the range of 0.5 μm-2.0 μm, preferably in the range of 1.0 μm-2.0 μm.

The coating on the zinc die-cast part typically has a layer thickness in the range of roughly 1.0 μm to roughly 2.0 μm. This makes the coating many times thinner than the coating built up by electroplating, which is usually around 10 μm. The coating produced by this process is therefore much more dimensionally stable.

In order to reduce the carry-over of liquid components from the previous treatment steps to the next treatment step, the treated zinc die-cast parts are allowed to drip dry after each treatment step.

Treated zinc die-cast parts may be subjected to one or more rinsing steps before being treated in the next liquid. This further reduces carry-over and contamination of the liquids. To prevent the liquids from becoming saline, fully demineralized water is used during the rinsing steps. The rinsing steps can be carried out at a temperature in the range of 20° C.-30° C.

Rinsing steps can be carried out after treatment with the first and/or second liquid. After treatment with the third liquid, there is no rinsing step to prevent the inorganic nanoparticles from being washed out and carried away.

After treatment with the third liquid, the zinc die-cast parts are dried. This can be done by evaporation of the liquid at room temperature. In order to achieve a reasonable drying time and therefore a more efficient process, zinc die-cast parts can be dried at 60° C.-85° C. by blowing or circulating air. In addition, or as an alternative, zinc die-cast parts can also be dried using infrared radiation.

During drying, the liquid evaporates from the capillaries and cavities, and the inorganic nanoparticles form a gel. In doing so, they enter a water-insoluble state, which is not reversible, and at least partially close the capillaries and cavities.

The process may be designed to ensure wetting of the zinc die cast parts with the appropriate fluids. For example, the zinc die-cast parts can be rotated to facilitate wetting. The process can be designed in such a way that the zinc die-cast parts pass through the individual treatment steps one after the other in a horizontal movement. In this case, the zinc die-cast parts can be moved through the individual liquids either on a conveyor belt or by means of a trolley. Treatment in drum systems, e.g. for bulk materials, on racks and in centrifugal systems, is also under consideration.

The invention also provides a multi-layered coating for the protection of zinc die-cast parts, comprising a first layer containing chromium(III), and a second layer on the first layer containing inorganic nanoparticles. The multi-layered coating can be constructed using the method described here.

In one possible embodiment, the inorganic nanoparticles are additionally embedded in capillaries and cavities of the first layer.

In a preferred embodiment, the inorganic nanoparticles will contain silicon dioxide. It is preferable for the inorganic nanoparticles to consist of silicon dioxide.

In another embodiment, the first layer may have a uniform thickness of 50 nm-100 nm.

The second layer can have a thickness in the range of 0.5 μm-2.0 μm, preferably in the range of 1.0 μm-2.0 μm.

The coating thus has a total thickness in the range of roughly 1.0 μm-roughly 2.0 μm. This makes the coating many times thinner than the coating built up by electroplating, which is usually around 10 μm. The presented coating is therefore significantly more dimensionally stable.

The process described here has a number of advantages over electroplating. For example, the coating thickness is uniform across the component, and is approximately 2 μm. The zinc die-cast parts are treated without electricity, so no hydrogen is produced, and there are no adhesion problems. The procedure can also be performed at higher loads. In addition, no substances are used that endanger health and/or the environment, such as chromium(VI), cobalt or solvents. Furthermore, compared to electroplating, rework is always possible.

All in all, the process used here, with a reduced number of process steps and a coating time of a few minutes, enables the zinc die-cast parts to be finished in a resource-efficient manner. This also means time savings on higher volumes, lower freight costs, and a reduction in transport damage.

Additionally, the invention provides a coated zinc die-cast part that has a first layer with chromium(III) on its surface and a second layer on the first layer, with the second layer containing inorganic nanoparticles. The coated zinc die-cast part can be produced by the process described here.

In one possible embodiment, the inorganic nanoparticles are additionally embedded in capillaries and cavities of the first layer.

In a preferred embodiment, the inorganic nanoparticles will contain silicon dioxide. It is preferable for the inorganic nanoparticles to consist of silicon dioxide.

In another embodiment, the first layer may have a uniform thickness of 50 nm-100 nm.

The second layer can have a thickness in the range of 0.5 μm-2.0 μm, preferably in the range of 1.0 μm-2.0 μm.

The coating thus has a total thickness in the range of roughly 1.0 μm-roughly 2.0 μm. This makes the coating many times thinner than the coating built up by electroplating, which is usually around 10 μm. The presented coating is therefore significantly more dimensionally stable.

There are now various ways to design and further develop the framework around the current invention in an advantageous manner. For further details, reference should be made to both the dependent claims following claim 1 and the subsequent explanation of preferred embodiments of the invention based on the figures. Generally preferred configurations and further developments of the framework are also explained in conjunction with the explanation of preferred embodiments of the invention based on the figures. In the figures, FIG. 1 illustrates a comparison of the corrosion resistance of differently treated zinc die-cast parts.

Figure 2:
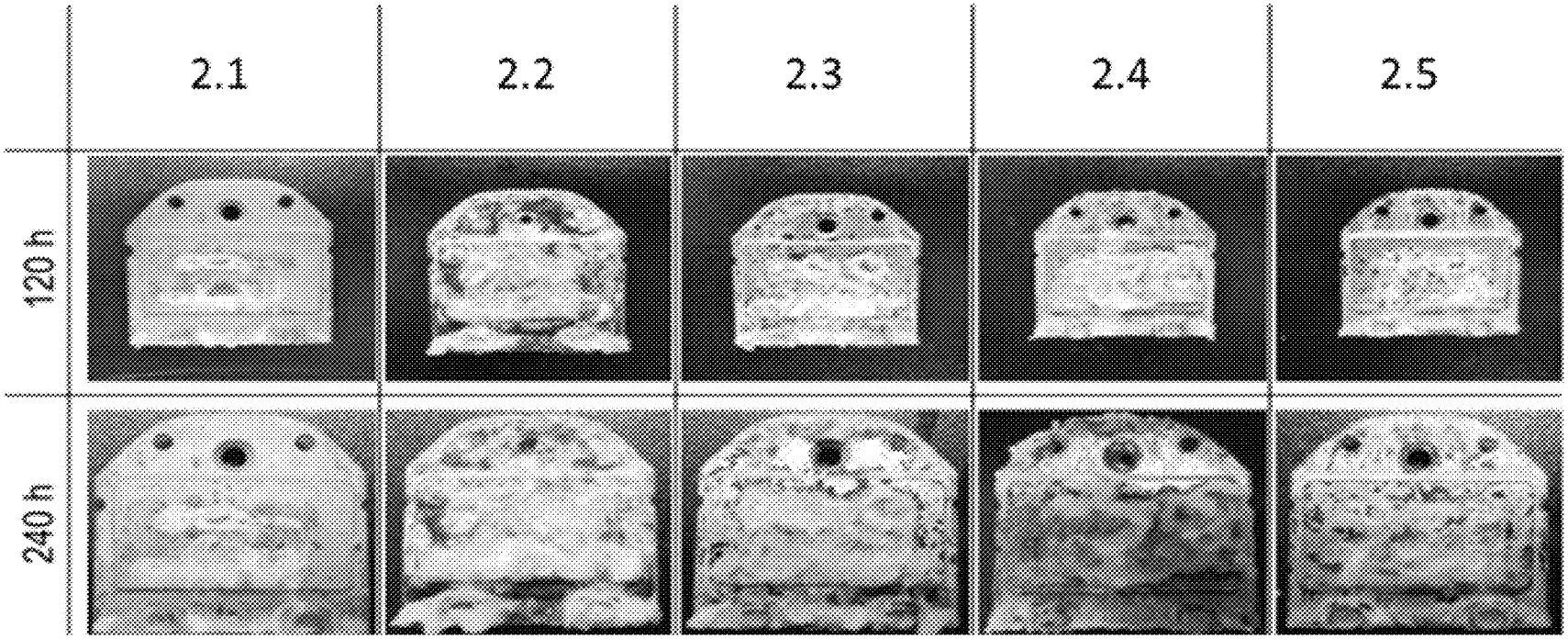

FIG. 2 shows a comparison of the corrosion resistance of differently treated zinc die-cast parts after tribological stress.

FIG. 1 shows the result of a corrosion resistance test of base plates for car roof antennas. Corrosion resistance was tested by means of a salt spray test (DIN EN ISO 92227). The illustrations show the corresponding base plates after 1200 hours in the salt spray.

The base plates have been coated through various different processes. The items tested included typical coatings that were built up via galvanic processes (1.1 to 1.7), and a base plate that was coated via the process claimed here (1.8). Base plate 1.1 is made of blue passivated zinc, base plate 1.2 is made of copper-nickel-tin alloy, base plate 1.3 is made of blue passivated and sealed zinc, base plate 1.4 is made of thick passivated and sealed zinc-iron, base plate 1.5 is made of black passivated and sealed zinc-iron, base plate 1.6 is made of thick passivated and sealed zinc, and base plate 1.7 is made of thick passivated zinc-iron.

FIG. 1 shows that after 1200 hours in salt spray, bottom plates 1.1, 1.2, 1.3, 1.5, 1.6 and 1.7 are heavily corroded. By contrast, base plates 1.4 and 1.8 show only minor corrosion. Compared to most of the coated base plates tested here, base plate 1.8 coated by the method claimed herein shows improved corrosion resistance. The corrosion resistance is at least comparable to that of thick-film passivated and sealed zinc-iron (base plate 1.4).

FIG. 2 shows the result of a corrosion resistance test of zinc die-cast parts after tribological stress. Corrosion resistance was tested by means of a salt spray test (DIN EN ISO 92227). The illustrations show the corresponding parts after 120 hours and 240 hours in the salt spray.

The zinc die-cast parts have been coated through various different processes. Typical coatings built up via galvanic processes (2.2 to 2.5) were tested; zinc die-cast parts coated via the process claimed herein (2.1) were tested as well. The die-cast part 2.2 was zinc-plated and blue chromated, the die-cast part 2.3 was zinc-plated and thick-film passivated, the die-cast part 2.4 was zinc-plated, thick-film passivated, and sealed, and the die-cast part 2.5 consists of thick-film passivated and sealed zinc-iron.

In the comparison of all coated die-cast parts, the part coated by the method claimed here (2.1) exhibits the lowest corrosion attack after 120 hours and 240 hours. Slight corrosion is only visible locally in the contact area. Corrosion in the remaining die-cast parts (2.2 to 2.5) has advanced considerably by the respective time points, and is already showing signs of deterioration.

FIG. 2 clearly demonstrates that the zinc die-cast part coated by the method claimed here (2.1) exhibits improved corrosion resistance in comparison to conventional coating methods after undergoing tribological stress.

For further preferred embodiments of the process within the scope of the invention, reference is made to the general part of the description and to the appended claims, in order to avoid repetition.

Finally, it should be explicitly noted that the embodiments described above serve only to illustrate the claimed method, and they do not limit the scope of the invention to these specific examples.

The invention claimed is:

1. A method for coating zinc die-cast parts comprising the steps:

i) treating the zinc die-cast parts with a first liquid containing at least one builder and at least one surfactant;

ii) treating the zinc die-cast parts with a second liquid to form a first layer on a surface of the zinc die-cast parts, where the second liquid contains at least one chromium (III) complex and at least one sulfate;

iii) treating the zinc die-cast parts with a third liquid to form a second layer on the first layer, where the third liquid contains inorganic nanoparticles; and iv) drying of the treated zinc die-cast parts, wherein the at least one sulfate in the second liquid is selected from the group consisting of magnesium sulfate, sodium hydrogen sulfate, potassium hydrogen sulfate, and combinations thereof, and wherein the chromium(III) complex is a chromium(III) fluoride complex.

2. The method according to claim 1, wherein the third liquid further comprises a polymer dispersion.

3. The method according to claim 1, wherein the third liquid comprises the inorganic nanoparticles as a colloidal dispersion in a range of 1.5% by weight to 10% by weight based on weight of the third liquid.

4. The method according to claim 1, wherein the inorganic nanoparticles contain silicon dioxide or consist of silicon dioxide.

5. The method according to claim 1, wherein the builder is a phosphate and/or wherein the surfactant is a non-ionic surfactant.

6. The method according to claim 1, wherein the first liquid further comprises an amphoteric surfactant.

7. The method according to claim 1, wherein the treating in step i) is carried out at a pH in the range of 11-12.

8. A multi-layered coating for protection of zinc die-cast parts, constructed by the method according to claim 1, wherein the coating comprises a first layer containing chromium(III) and a second layer on the first layer containing inorganic nanoparticles.

9. A coated zinc die-cast part produced by the method according to claim 1, wherein the surface of the zinc die-cast part has a first layer with chromium(III) and a second layer on the first layer containing inorganic nanoparticles.

* * * * *